US005325105A

United States Patent [19]

Cermignani et al.

[11] Patent Number: 5,325,105

[45] Date of Patent: Jun. 28, 1994

[54] ULTRA-BROADBAND TEM DOUBLE FLARED EXPONENTIAL HORN ANTENNA

[75] Inventors: Justine D. Cermignani, Fort Salonga; Donald Kerbs, E. Northport; John R. Anderson, Brooklyn, all of N.Y.

[73] Assignee: Grumman Aerospace Corporation, Bethpage, N.Y.

[21] Appl. No.: 848,016

[22] Filed: Mar. 9, 1992

[51] Int. Cl.[5] ..... H01Q 13/02

[52] U.S. Cl. ..... 343/786; 343/859

[58] Field of Search ..... 343/786, 859, 767, 795; H01Q 13/00, 13/06, 13/08, 13/02

[56] References Cited

U.S. PATENT DOCUMENTS

| | | | |
|---|---|---|---|
| 2,454,766 | 11/1948 | Brillouin | 343/786 |
| 2,946,999 | 7/1960 | Kelleher et al. | 343/786 |
| 3,312,975 | 4/1967 | Huelskamp | 343/786 |
| 4,201,956 | 5/1980 | Kienberger et al. | 343/786 |
| 4,918,458 | 4/1990 | Brunner et al. | 343/795 |
| 5,081,466 | 1/1992 | Bitter | 343/767 |

OTHER PUBLICATIONS

The ARRL Antenna Book, Published by the ARRL, Newington, Conn., 15th Edition, 1988, pp. 20–25 to 20–26.

Sengupta et al., "Rudimentary Horn Antenna," IEEE Transactions on Antennas and Propagation, Jan. 1971, pp. 124–126.

Cohn, "Design of Simple Broad-Band Wave-Guide-to-Coaxial-Line Junctions," Proceedings of the I.R.E., Sep. 1947, pp. 920–926.

*Primary Examiner*—Michael C. Wimer

*Attorney, Agent, or Firm*—Scully, Scott, Murphy & Presser

[57] ABSTRACT

An ultra-broadband transverse electromagnetic (TEM) exponential antenna in which the radiating or receiving structure comprises first and second elongated conductors have a feed end comprising first and second narrow conductor strips. At an opposite radiating or receiving end, the widths of the first and second conductors expand exponentially in the H-plane, and the spacing between the first and second conductors expands exponentially in the E-plane, thereby providing a double flared, exponentially tapered, transverse electromagnetic horn antenna. Two TEM horn design embodiments are described herein and differ only in the lauching device by which the radiating structure is fed, which converts an input unbalanced transverse electromagnetic wave into a balanced transverse electromagnetic wave. A first preferred embodiment employs a stripline infinite balun as a launching device, while a second embodiment employs a cavity backed waveguide as a launching device. An input coaxial connector introduces an unbalanced transverse electromagnetic wave into the launching device, either the infinite balun or the cavity backed waveguide.

6 Claims, 13 Drawing Sheets

ULTRA-BROADBAND TEM DOUBLE FLARED EXPONENTIAL HORN ANTENNA

BACKGROUND OF THE INVENTION

1. Field of the Invention

The present invention relates generally to an ultra-broadband transverse electromagnetic (TEM) exponential horn antenna, and more particularly pertains to an antenna as described wherein at the radiating or receiving end, the widths of first and second conductors expand exponentially in the H-plane, and the spacing between the first and second conductors expands exponentially in the E-plane, thereby providing a double flared, exponentially tapered, transverse electromagnetic horn antenna.

An antenna as described herein can function as either a receiving or transmitting antenna. As a transmitting antenna, an impulse function can be utilized as the transmitted waveform, which results in a theoretically infinite bandwidth for the antenna.

The design of ground based or airborne radar systems which utilize an impulse function as a transmitted waveform has recently become of interest because the frequency spectrum of an impulse waveform has a theoretically infinite bandwidth. An ultra-broad bandwidth results in a radar system with unique capabilities, such as foliage penetration at low frequency wavelengths and high target resolution achieved at high frequency wavelengths.

The key components of an impulse function radar system are the receive and transmit antennas which require the combined attributes of ultra-broadband frequency response, high gain for long range target detection, high transmit voltage stand-off necessary for handling the necessary waveform power in nanosecond time frames, and nondispersive phase properties to maintain waveform fidelity. The present invention provides a design for a novel ultra-broadband antenna designed to be used in combination with a parabolic reflector, which should provide all of the electrical properties described above.

2. Discussion of the Prior Art

The prior art has considered a similar design for a TEM horn antenna, but wherein the conductor strips forming the antenna have a linearly expanding flare, not an exponentially expanding double flared design. Moreover, the prior art antenna is also not flared in both the H-plane and the E-plane to provide a double flared design similar to that of the present invention.

The design of an infinite balun component as described herein is well known in the art, and infinite baluns have been used with spiral or helix antennas, but not with an ultra-broadband transverse electromagnetic horn antenna similar to that of the present invention.

SUMMARY OF THE INVENTION

Accordingly, it is a primary object of the present invention to provide an ultra-broadband transverse electromagnetic exponential horn antenna.

A further object of the subject invention is the provision of an antenna as described which is designed to be used in combination with a parabolic reflector, thereby providing high gain for long range target detection, high transmit voltage stand-off necessary for handling the necessary waveform power in nanosecond time frames, and nondispersive phase properties to maintain waveform fidelity.

In accordance with the teachings herein, the present invention provides an ultra-broadband transverse electromagnetic exponential antenna in which the radiating or receiving structure comprises first and second elongated conductors have a feed end comprising first and second narrow conductor strips. At an opposite radiating or receiving end, the widths of the first and second conductors expand exponentially in the H-plane, and the spacing between the first and second conductors expands exponentially in the E-plane, thereby providing a double flared, exponentially tapered, transverse electromagnetic horn antenna.

Two TEM horn design embodiments are described herein and differ only in the mechanism by which the radiating structure is fed, that is, the launching device. A first preferred embodiment employs a stripline infinite balun as a launching device, while a second embodiment employs a cavity backed coax-to-waveguide transition as a launching device.

In a first preferred embodiment, the input to the first and second conductors is formed by an infinite balun which converts an input unbalanced transverse electromagnetic wave into a balanced transverse electromagnetic wave. The infinite balun comprises a first narrow microstrip conductor and a second parallel ground plane conductor which are connected at their outputs respectively to the first and second narrow conductor strips at the feed end of the antenna. An input coaxial connector introduces an unbalanced transverse electromagnetic wave into the infinite balun, and comprises a central conductor and a concentric outer conductor which are connected respectively to the first and second parallel conductors at the input of the infinite balun.

In a second disclosed embodiment, a cavity backed waveguide is utilized rather than an infinite balun for converting an input unbalanced transverse electromagnetic wave to a balanced transverse electromagnetic wave.

The exponential horn antenna of the present invention can function as a transmitting antenna which is coupled to an input electromagnetic signal, or can function as a receiving antenna which detects and produces an output electromagnetic signal.

An antenna pursuant to the present invention is formed by two conductive strips, which can be formed of sheet metal, which at the feed end are narrow and parallel and separated by a dielectric having a dielectric constant approximately the same as the dielectric constant of air. The two conductive strips flare exponentially in width in the plane of the magnetic field (H-plane) and also flare exponentially apart in the plane of the electric field (E-plane). The radiation properties of the antenna are created by a traveling TEM wave originating in a standard coaxial connector with an unbalanced field, feeding an infinite balun which converts the wave to a balanced TEM field, which is transmitted to a smooth double exponentially flared TEM horn antenna. Unusually broad frequency bandwidths are achieved because of the smooth exponential tapers of the radiating elements and also because of the frequency independence of the infinite balun.

Tests on a preferred embodiment have demonstrated a frequency bandwidth of over 40 to 1 with a VSWR (voltage standing wave ratio) less than 2 to 1 without the use of lossy materials in the design (bandwidth is more than 60 to 1 with a VSWR less than 2.5 to 1), and a high voltage DC standoff of 4 kilovolts as measured with "HiPot" equipment. The antenna preserves the fidelity of the transmitted or received waveform because the phase velocity of the TEM wave is frequency independent, thereby producing virtually no phase dispersion. The physical geometry of the smooth transitions also provides high voltage stand-off capabilities. The antenna provides virtually no phase dispersion, the high voltage DC stand-off is better than 4 kilovolts, and the pattern directivity at all frequencies is better than 4.5 dbs above isotropic.

The present invention provides an ultra wideband source antenna which is useful for automated pattern measurement ranges, which eliminates the need for time consuming measurement interruptions normally required to change the source antenna to accommodate different frequency bands.

The ultra-broad bandwidth and low pattern directivity of the present invention make it a candidate for a variety of applications in airborne electronic countermeasures, such as in jamming wherein it would replace groupings of antenna elements necessary to provide a broadband transmission.

The present invention also has significant applications in impulse radar systems, detection of low-observables, medical electronics, test instrumentation in geological surveys, and test antenna instrumentation. Commercial applications include geological surveys conducted with short pulse airborne radar systems or radiometers which penetrate the earth's surface in particular frequency bands, and in medical electronics technologies involving the use of ultra-wideband processing and/or short pulse waveforms. Low power, short pulse embodiments may be able to supplement CAT scans and sonograms, with a resolution possibly better than CAT scans or sonograms.

BRIEF DESCRIPTION OF THE DRAWINGS

The foregoing objects and advantages of the present invention for an ultra-broadband TEM horn antenna may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
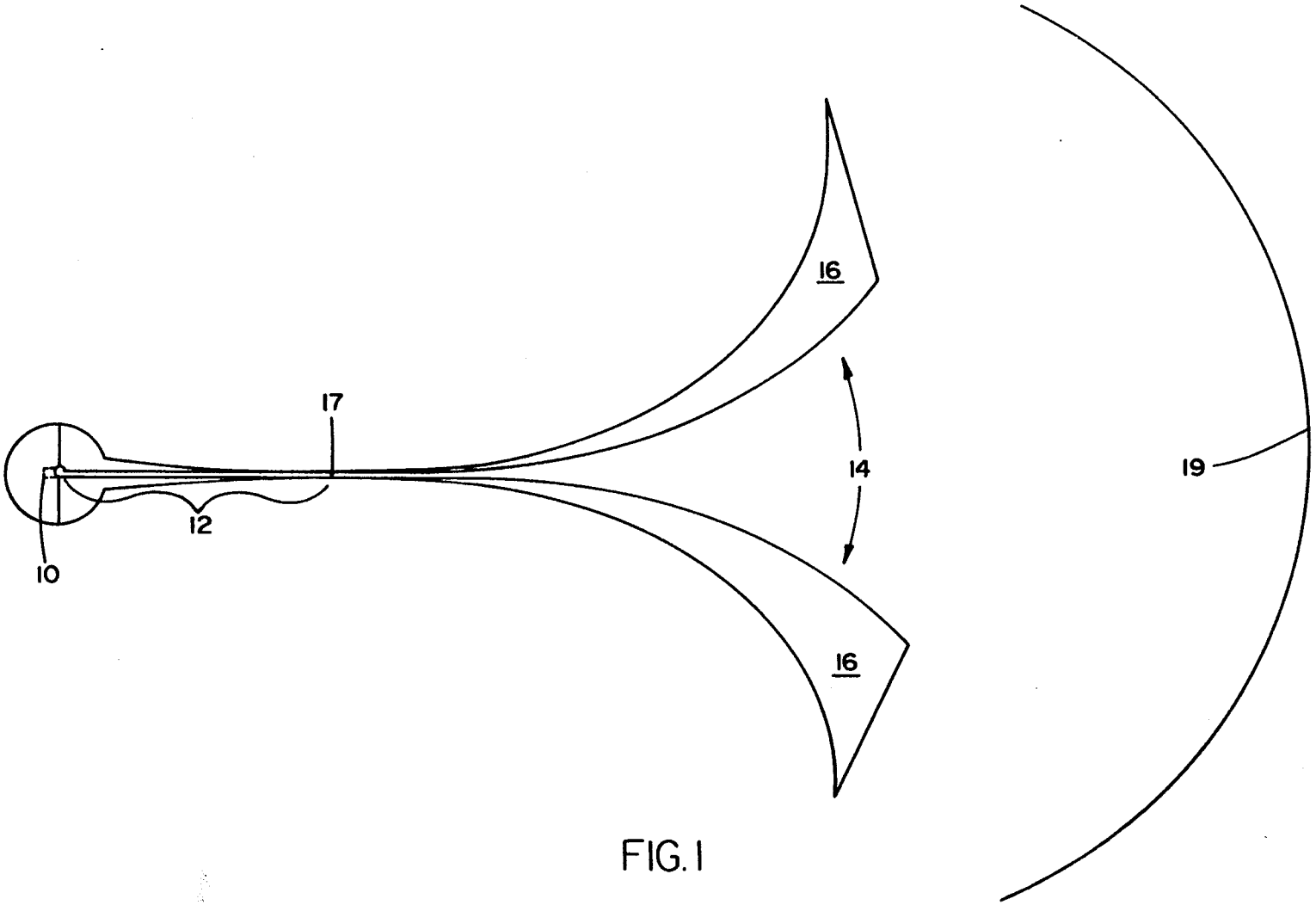
FIG. 1 illustrates a first preferred embodiment of the present invention for a transverse electromagnetic horn antenna having an infinite balun feeding a balanced horn-like radiating aperture which is simultaneously flared in both the plane of the electric field (E-plane) and the plane of the magnetic field (H-plane)
Figure 2:
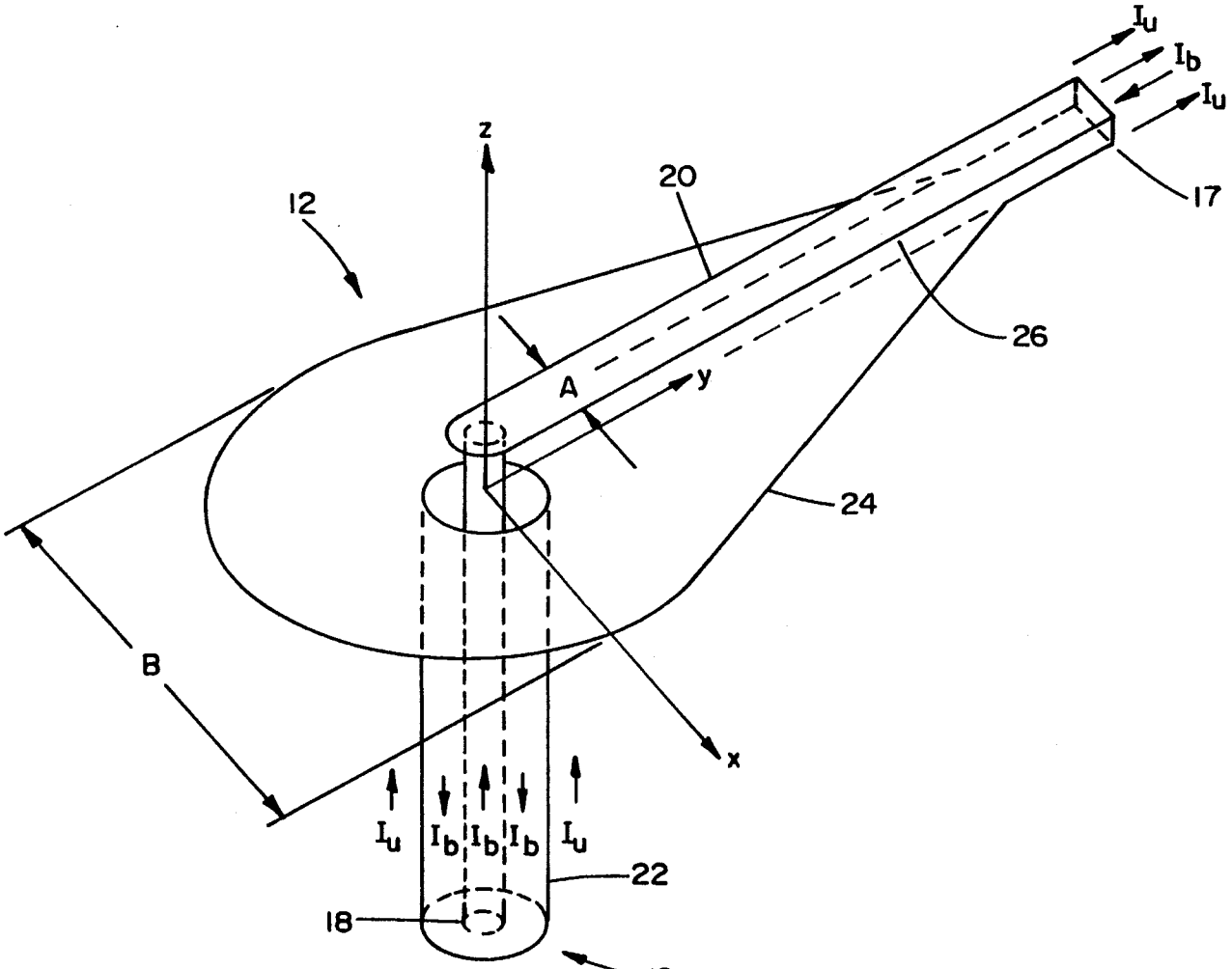
FIG. 2 depicts a frequency independent, infinite or tapered balun which provides a gradual transition from coaxial to a balanced cross-section, which converts an input unbalanced electromagnetic wave to a balanced electromagnetic wave which is an input to the balanced horn-like radiating aperture.
Figure 3:
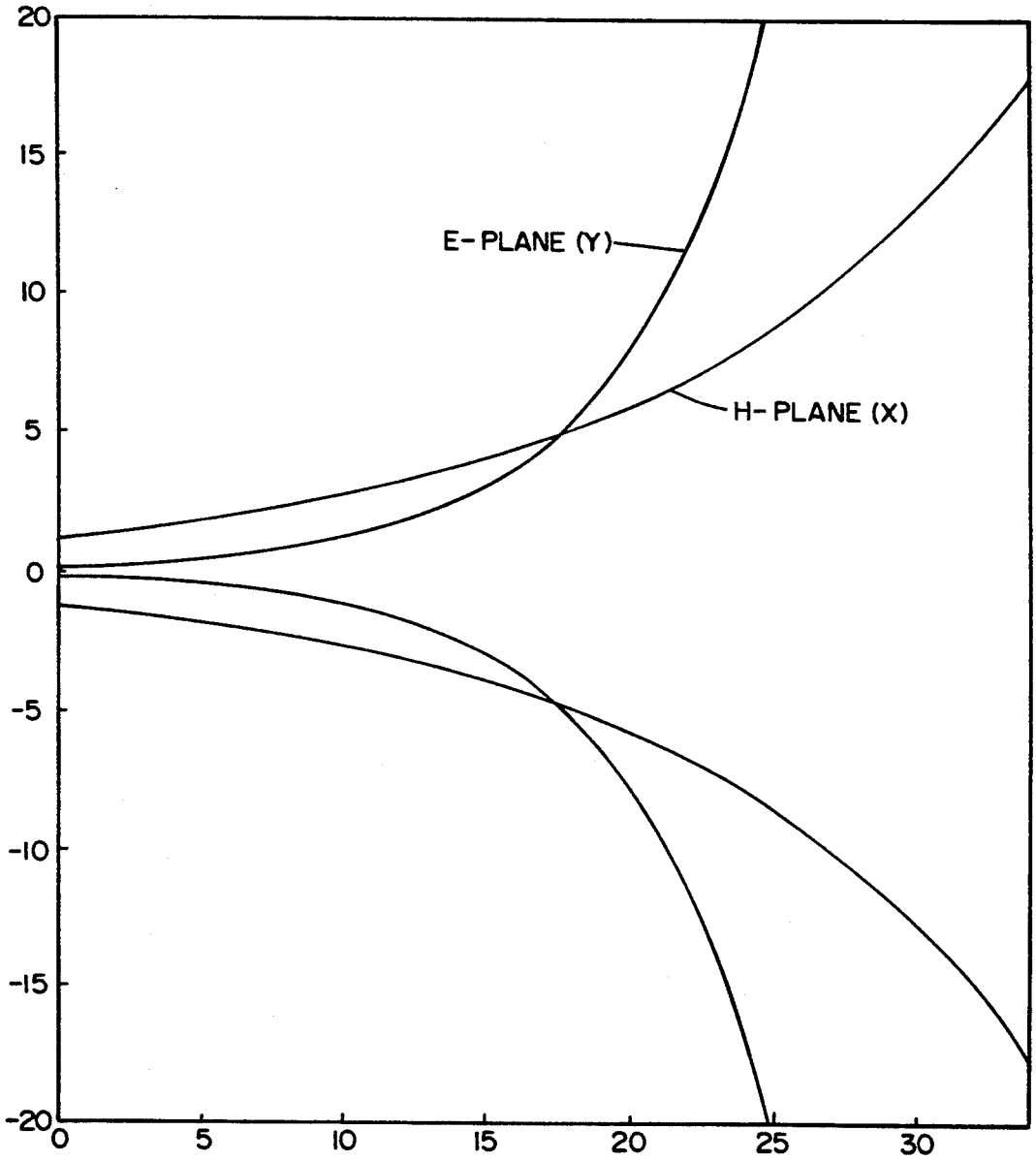
FIG. 3 illustrates plots of the E-plane (y) and H-plane (x) exponential design equations for one design of an exponential aperture taper for the embodiment of FIGS. 1 and 2.

Referring to the drawings in detail, FIGS. 1–3 illustrate a first preferred embodiment of the present invention for a transverse electromagnetic horn antenna having a coaxial connector input 10 for an infinite balun 12 feeding a balanced horn-like radiating aperture 14 which is simultaneously flared in both the plane of the electric field (E-plane, which is the flare of each sheet metal conductor 16) and the plane of the magnetic field (H-plane, which is the flare apart of the sheet metal conductors 16). The radiating elements of the ultra-broadband TEM double flared exponential horn antenna form a balanced TEM transmission line (which is an extension of the launching device, in this embodiment the infinite balun 12) which gradually separates while increasing in width in the orthogonal plane as an exponential function of distance. The exponential tapers are chosen to produce a slowly increasing characteristic impedance so that a TEM mode is supported and will be guided into free space which gives the antenna its bandwidth and its dispersionless characteristics. A design trade-off between the length of the structure and its exponential expansion rate determines the necessary aperture size in order to adequately excite the low frequencies without truncating its usable frequency bandwidth, since broadbanding favors a long and gradual taper of this structure. The present invention provides a design for a novel ultra-broadband antenna which can be designed to be used in combination with a parabolic reflector 19 as illustrated in FIG. 1, which should provide all of the electrical properties described hereinbelow. The design equations for one preferred exponential aperture taper are presented in FIG. 3, which illustrates graphs of the E-plane (y) and H-plane (x) design equations for one preferred design of an exponential aperture taper. In the interest of limiting the length of the horn, two such tapers with different exponential expansion rates were fabricated and tested. The first taper had a length of 21 inches and a maximum separation of 20 inches which was found to have a marginal VSWR performance at the low end of the band (VSWR - 5:1 at 300 MHz). The second version described as a preferred embodiment herein was 24 inches long with a maximum separation of 34 inches which considerably improved the low frequency response (VSWR - 3:1 at 300 MHz).

The E-plane (y) exponential curve and the H-plane (x) exponential curve follow the equation:

$$y=(+/-)0.18.EXP[Z/22.Ln\ (71.875)]$$

$$x=(+/-)\ 1.2.EXP[Z/26.7346.Ln\ (8.33333)]$$

The gap height=0.32 inches.
The plate width at the feed=2.4 inches.
The horn aperture=34 inches.
The horn width=20 inches.
The horn length=24 inches.

Radiation occurs in the region of the TEM horn where the plates are separated by approximately one half wavelength. Thus the phase center of radiation moves outwardly from the throat of the horn as the frequency is decreased.

The radiating mechanism is similar to that which occurs with a Vivaldi antenna, that is, a traveling TEM wave is guided by slowly separating plates away from the feed balun toward the ends of the horn. This traveling wave is slowly converted to spherical radiating modes which occur at distances closer to the feed as the frequency of the wave is increased.

The width and separation of the plates at the feed point 17 should be identical with the output cross section geometry of the infinite balun in order to avoid mismatch and to maintain balance.

Ideally, the TEM horn is fed or excited in a balanced mode or manner. In a balanced mode, the voltage on the elements of the transmission line are of equal magnitude, but opposite phase (180 degrees) from each other, for any given point in time and equal positions along the transmission line. Any deviation from the above balanced condition represents an unbalanced component of the excitation which is radiative in nature and usually manifests itself by radiation in undesirable directions. Accordingly, generation in an unbalanced mode is prevented or at least minimized.

Because the TEM horn is essentially frequency independent in nature, a corresponding frequency independent infinite balun 12 was selected as the feeding structure in the first preferred embodiment. As illustrated in FIGS. 1 and 2, the coaxial connector 10 is a standard 50 ohm commercially available connector, the central conductor 18 of which is connected to a narrow microstrip conductor 20 of the infinite balun, and the outer concentric conductor 22 of which is connected to the ground plane conductor 24 of the infinite balun 12. An infinite or tapered balun is simply a gradual transition from the coaxial input to a balanced cross section, which accomplishes the mode conversion if the transition is spread out over a sufficient portion of a wavelength at the lowest frequency. The input to the infinite balun is 50 ohm coaxial and the output is a parallel plate balanced line. The output can be transformed to any reasonable characteristic impedance by also tapering dimension A, the microstrip line width. For this design, the output impedance is 50 ohms, balanced, to match the input impedance of the TEM horn.

To maintain a true TEM configuration for the infinite balun, a supporting dielectric medium 26 between the microstrip 20 and the ground plane 24 must be homogeneous. High dielectric constant supports for the microstrip cause deviations from TEM with a resultant loss in bandwidth. For this reason, supports 26 having a dielectric constant as close to air as possible are used.

The design of an appropriate infinite balun 12 is well known in the art, and takes into account well known textbook considerations. The height h of the microstrip conductor 20 above the tapered ground plane 24 is a constant, and is selected to be sufficiently low enough to prevent the support of higher order, non-TEM modes. The characteristic impedance at either end of the balun are functions of the conductor width to height ratio. The height of the conductor also impacts upon and affects the voltage standoff. Thus the final dimensions of the infinite balun involve a number of trade-offs between peak withstanding voltage requirements, suppression of moding, the highest frequency of operation, and avoidance of very thin conductors at the output of the balun.

Figure 4:
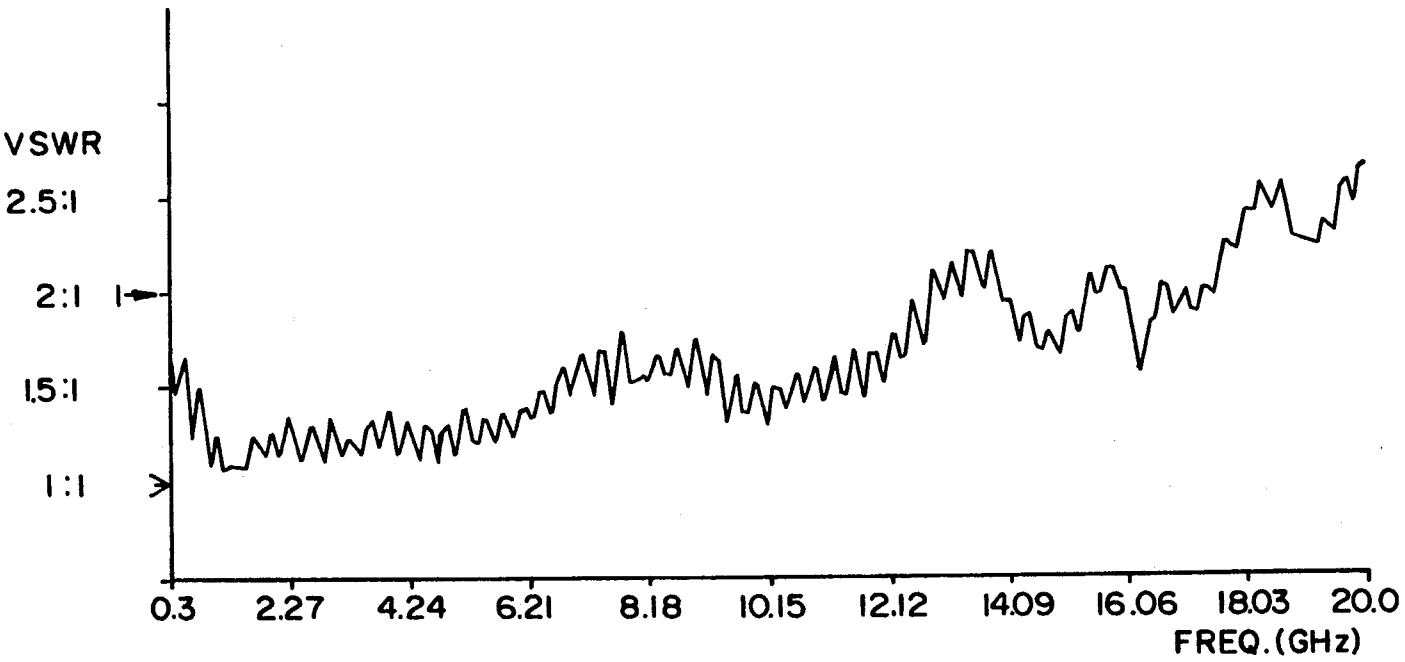
FIG. 4 is a plot of the input voltage standing wave ratio (VSWR) versus frequency which shows a VSWR of less than 2:1 over a 40:1 frequency bandwidth and less than 2.5:1 over a 60:1 frequency bandwidth without the use of lossy materials in the design of the antenna.
Figure 5:
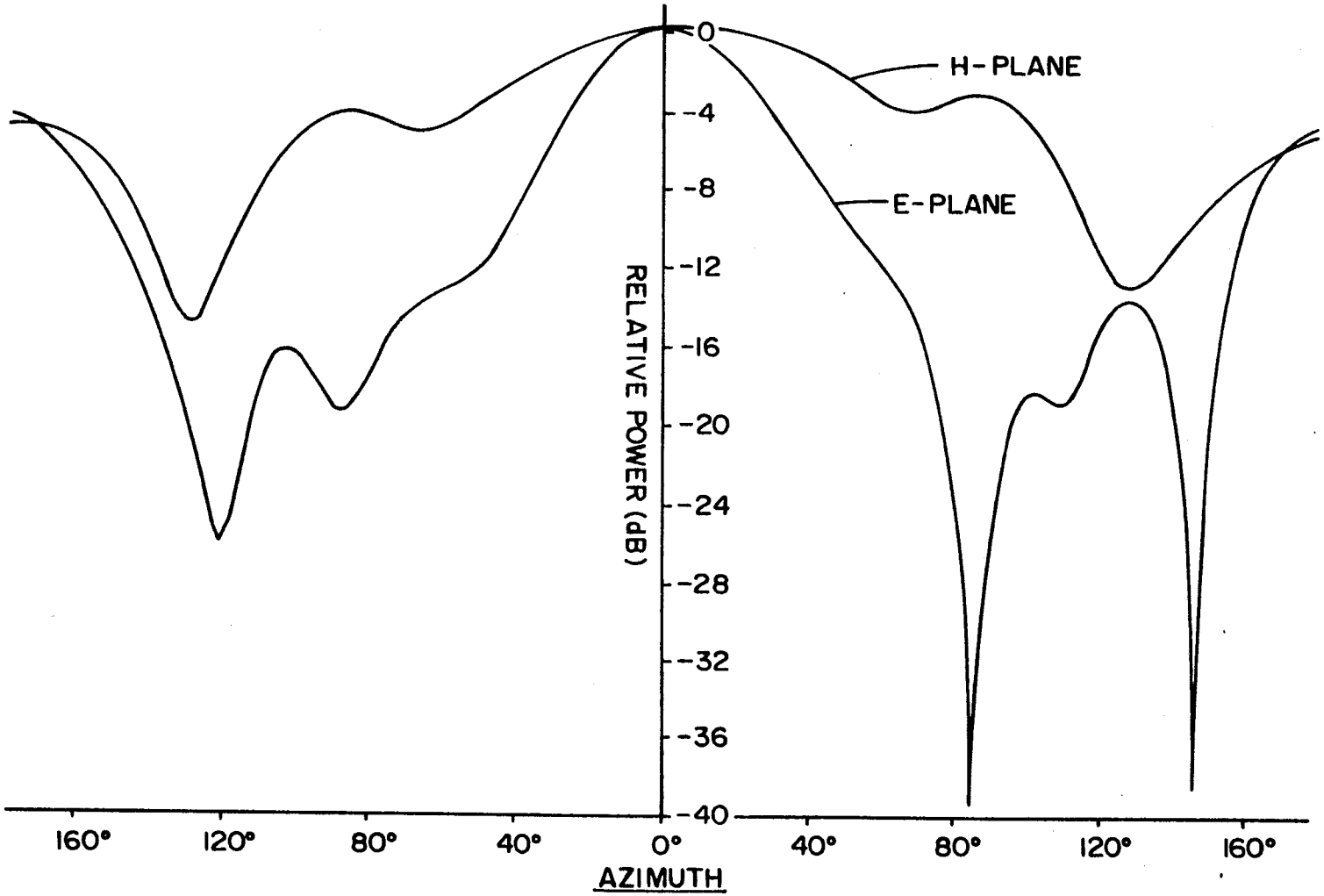
FIGS. 5 through 8 illustrate radiation characteristics for an antenna as shown in FIGS. 1–3, with representative E-plane and H-plane patterns for respectively 0.3 GHz (FIG. 7), 4.5 GHz (FIG. 8), 10 GHz (FIG. 9), and 12 GHz (FIG. 10).
Figure 6:
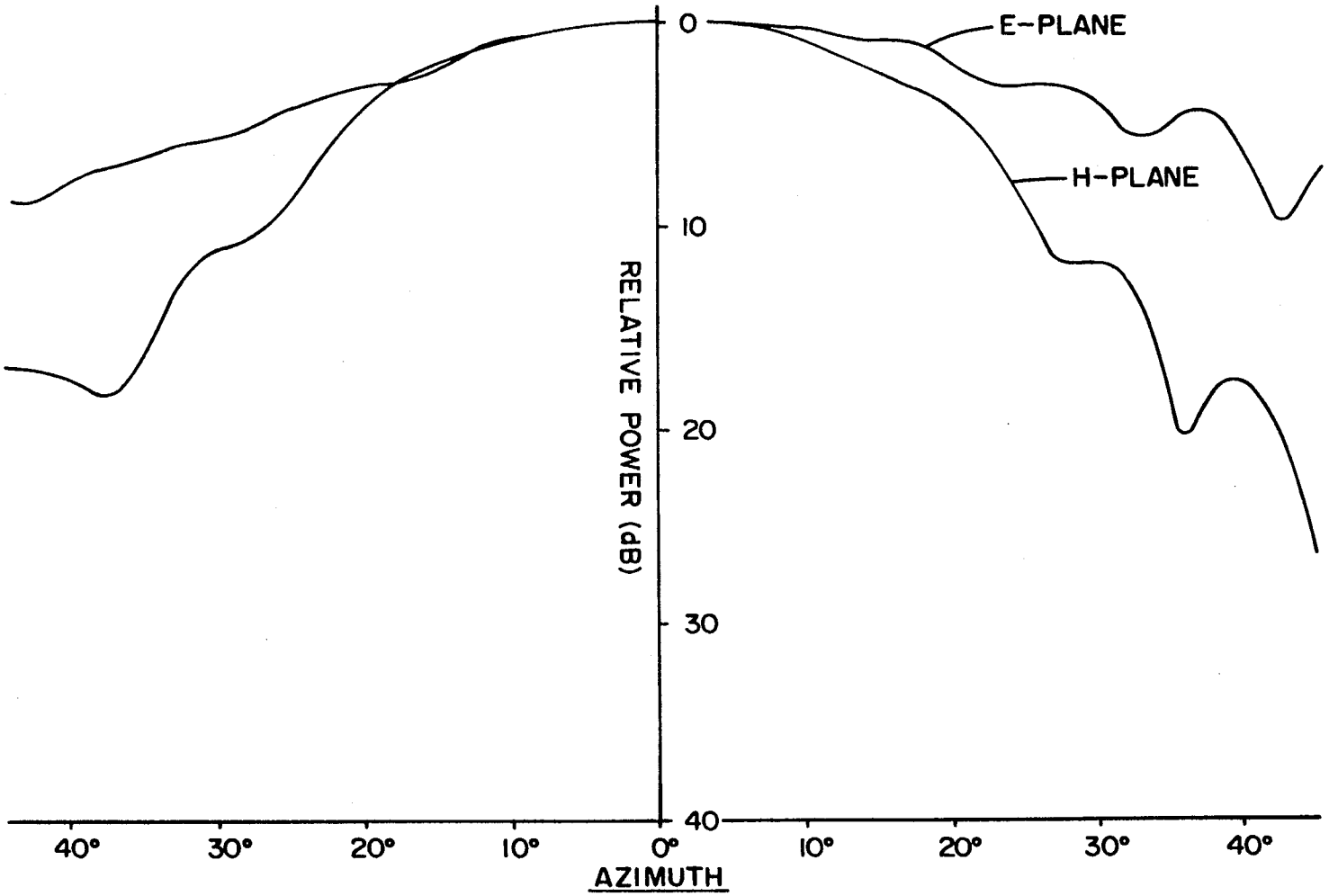
Figure 7:
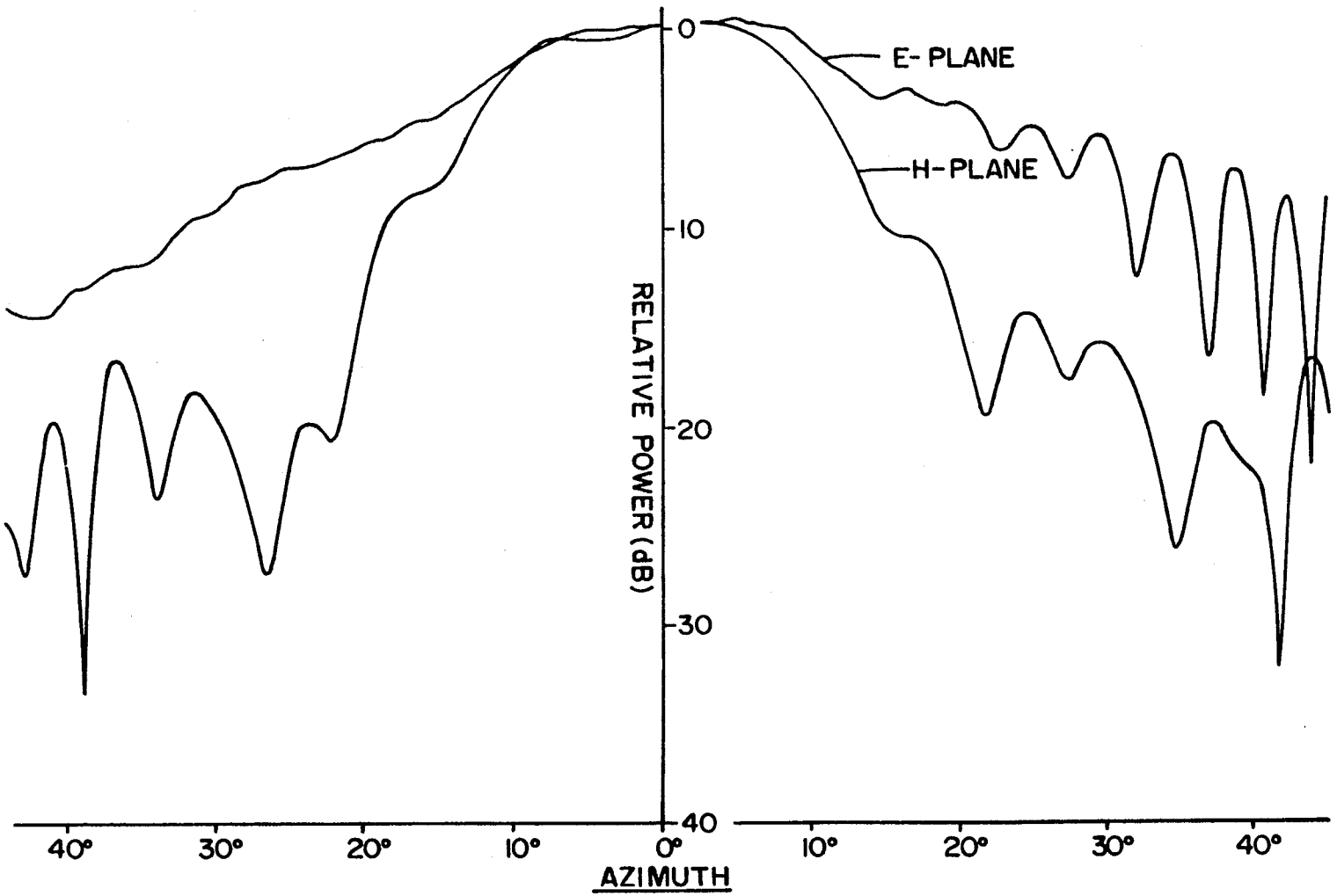
Figure 8:
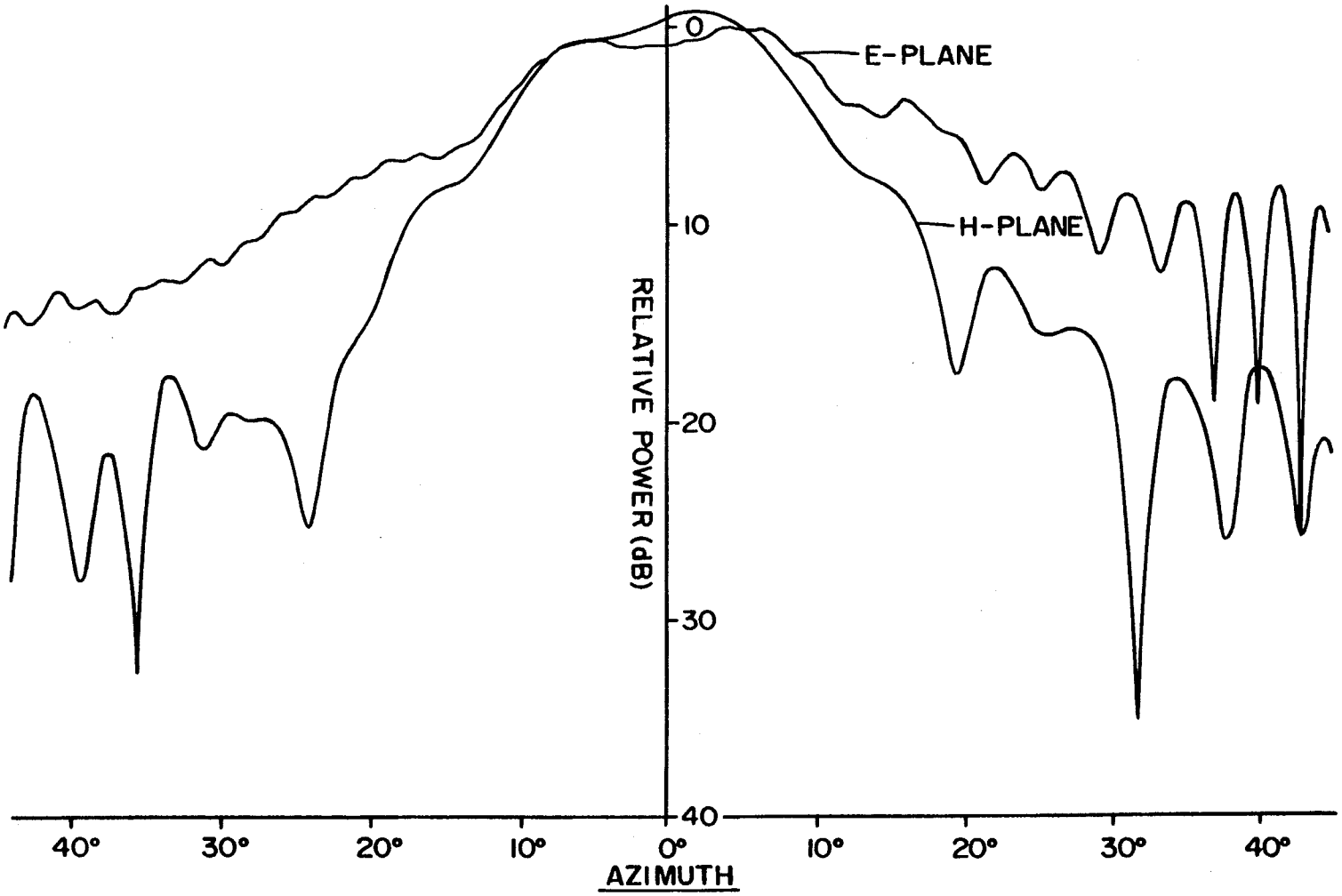

An antenna with the dimensions shown in FIG. 3 has an input voltage standing wave ratio (VSWR) versus frequency characteristic shown in FIG. 4, and radiation characteristics shown in representative E-plane and H-plane patterns depicted in FIG. 5 to FIG. 8.

Figure 9:
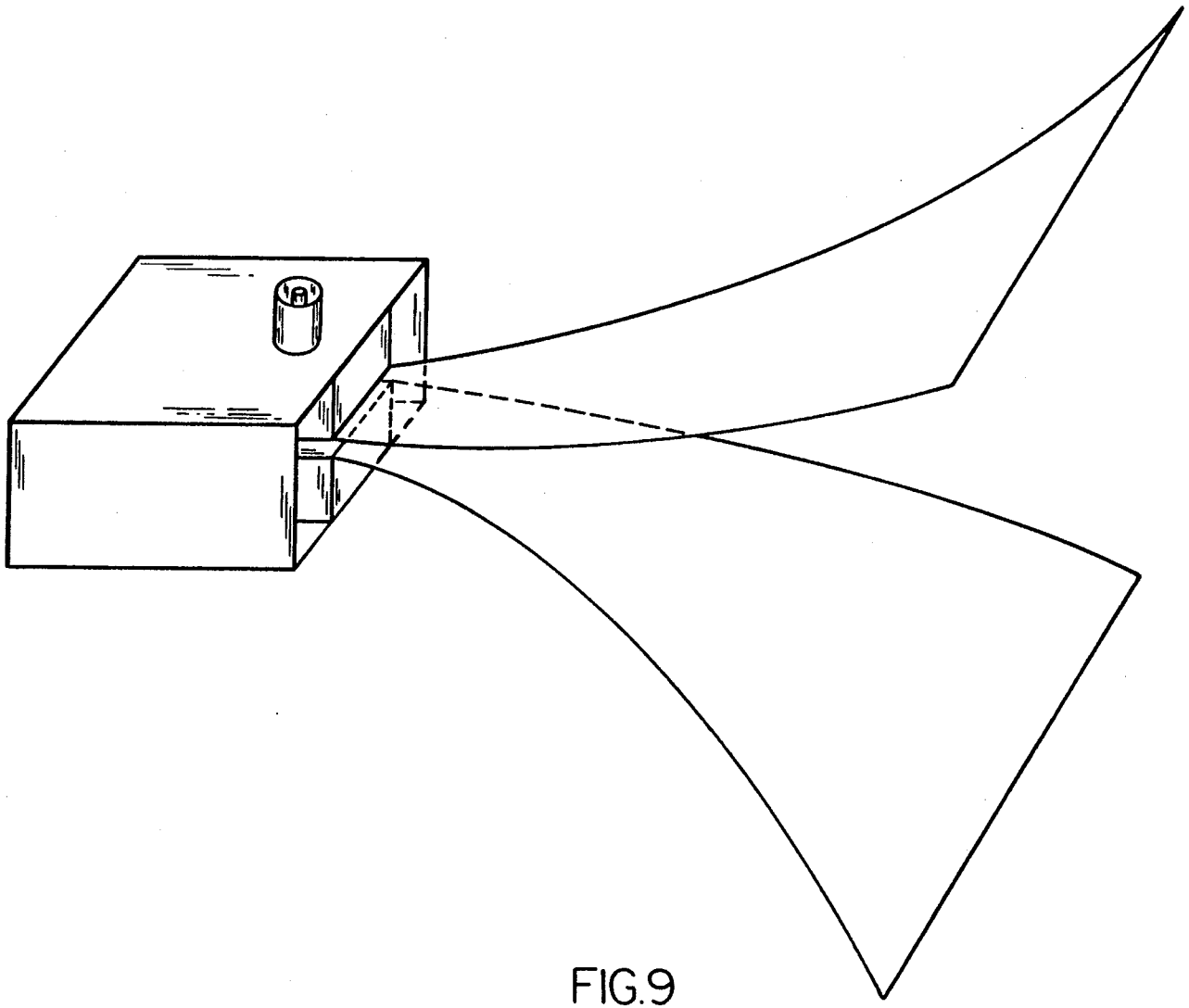
FIG. 9 illustrates a second embodiment of the present invention for a transverse electromagnetic horn antenna having a cavity backed waveguide feeding a balanced horn-like radiating aperture which is simultaneously flared in both the plane of the electric field (E-plane) and the plane of the magnetic field (H-plane)
Figure 10:
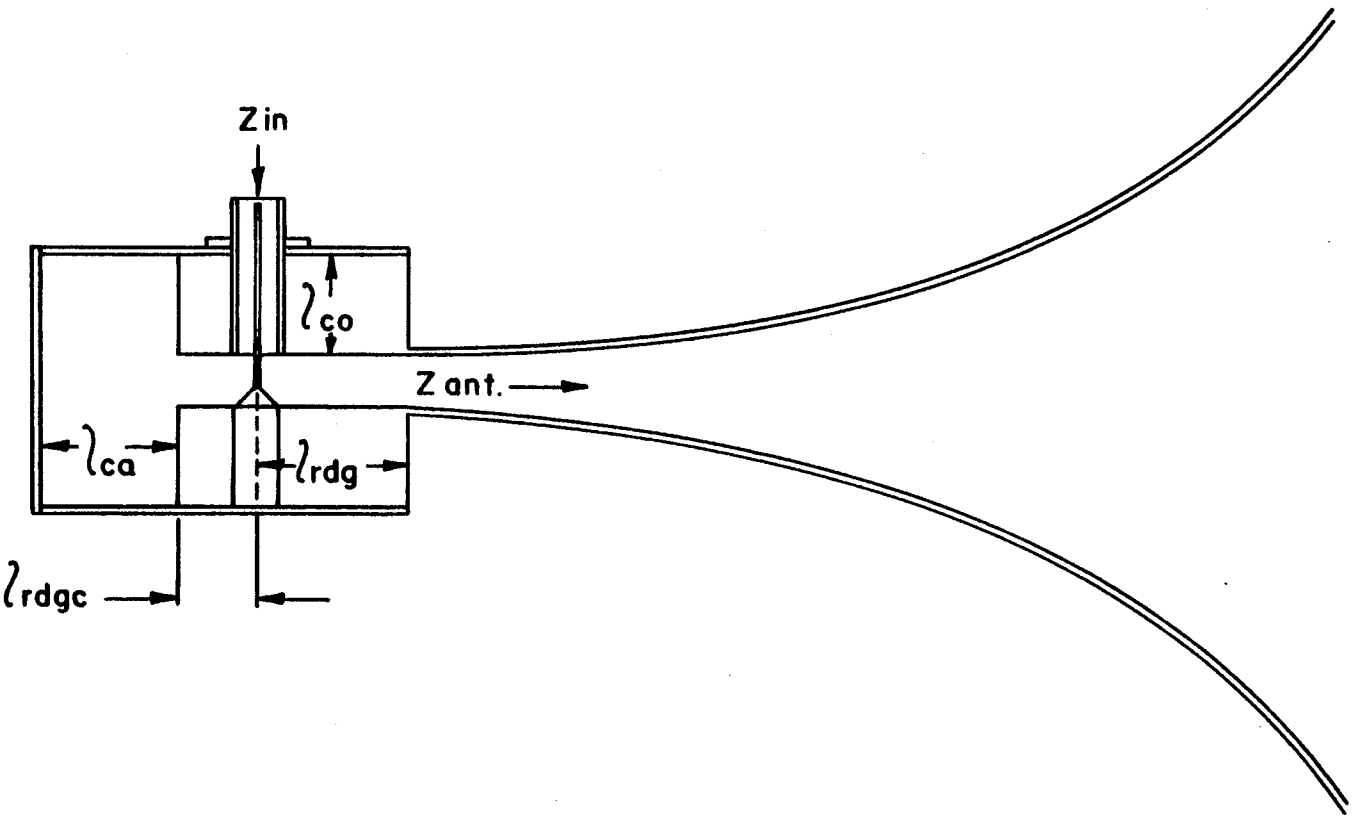
FIGS. 10 and 11 are sectional views of the cavity backed waveguide illustrating the electrical connections therein and significant design dimensions thereof.
Figure 11:
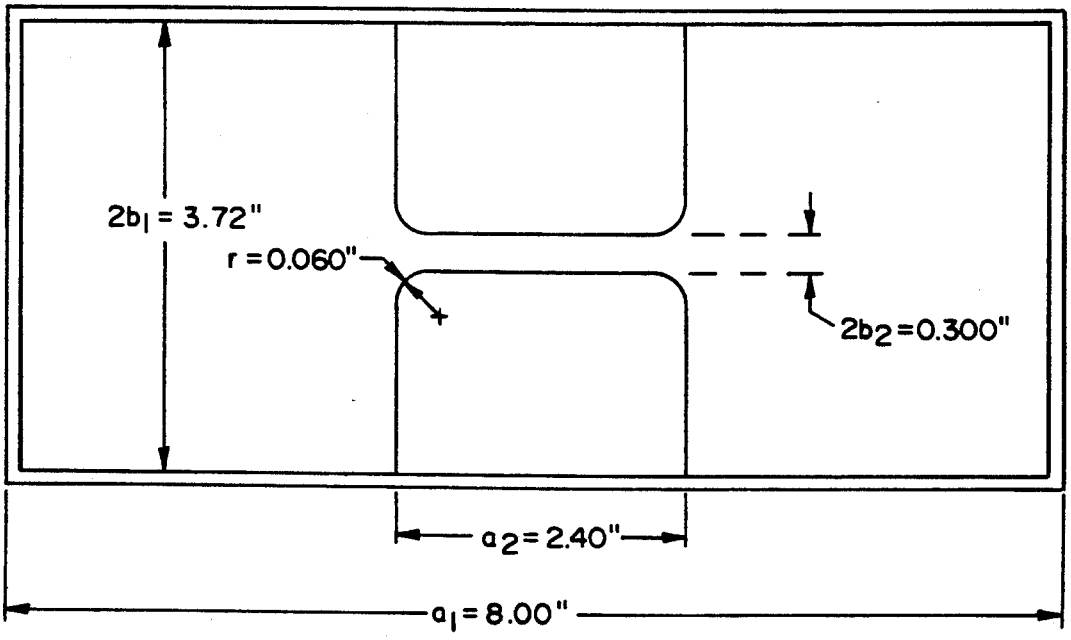

FIG. 9 illustrates a second embodiment of the present invention wherein the radiating structure is fed by a launching device comprising a cavity backed coax-to-waveguide transition, rather than a stripline infinite balun.

Figure 12:
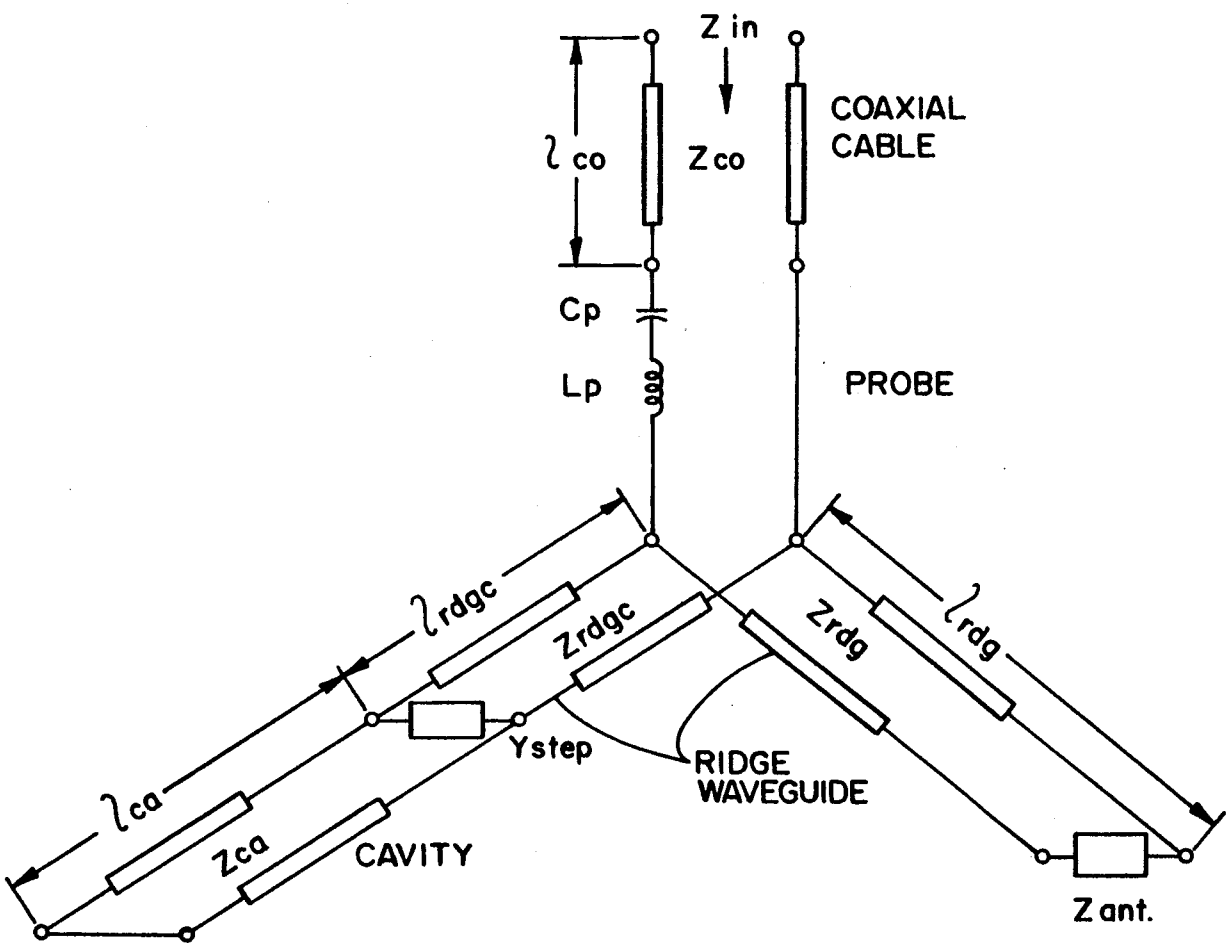
FIG. 12 depicts the equivalent electrical network for the coaxial to waveguide junction of the coaxial connector and the cavity backed waveguide.
Figure 13:
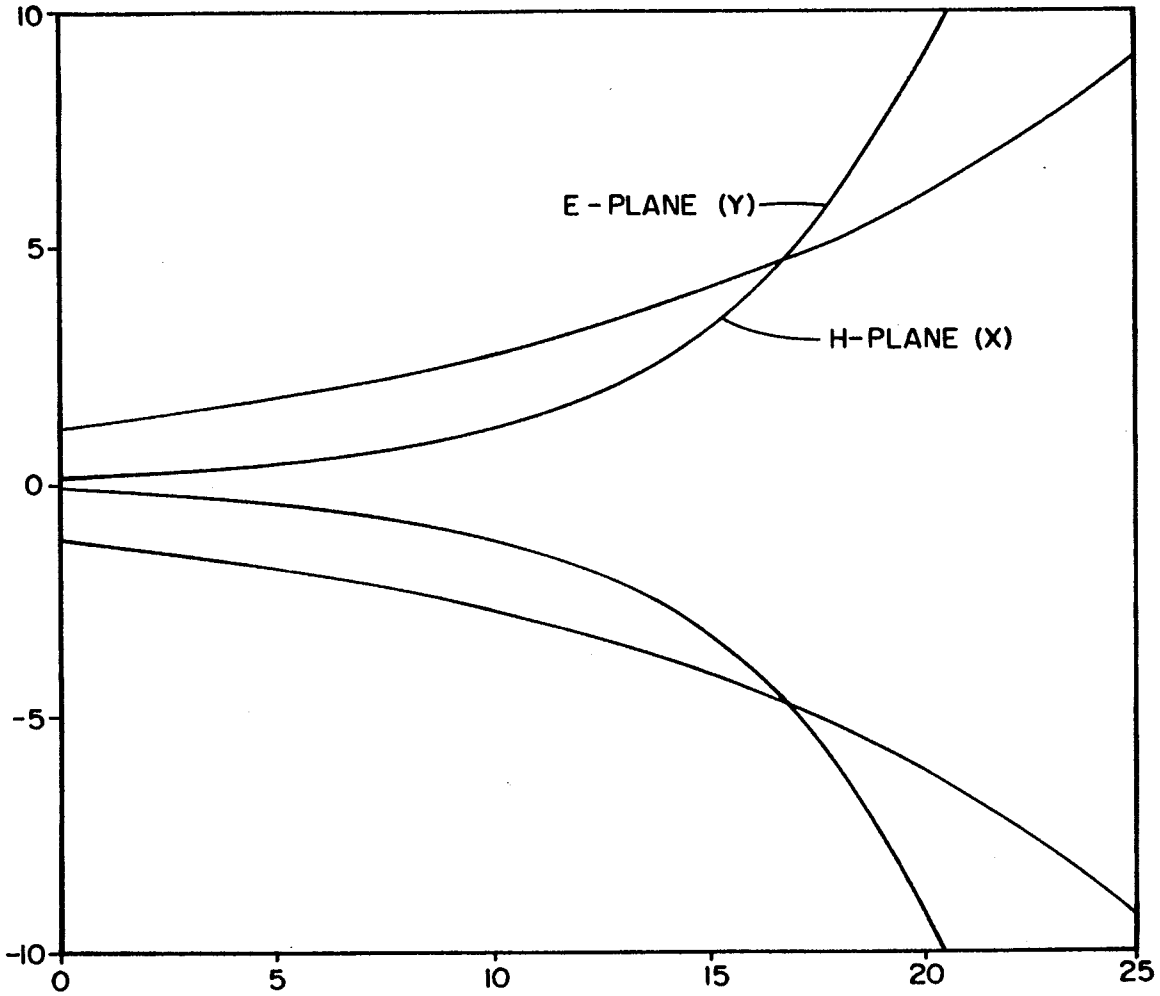
FIG. 13 illustrates plots of the E-plane (y) and H-plane (x) exponential design equations for one design of an exponential aperture taper for the embodiment of FIGS. 9–12.

Basically, broadband impedance matching is achieved through the interaction of two transmission line networks utilizing a ridged waveguide in parallel with an input coaxial current fed probe. The equivalent electrical network of the device is shown in FIG. 12. Since the cut-off frequency of the cavity is naturally higher than that of its cascaded ridged waveguide, at the low end of the frequency band the cavity essentially presents an open circuit in parallel with the coaxial probe so that essentially all the energy is directed along the ridged waveguide transmission line toward the antenna. At the longer wavelengths, step discontinuities and short transmission line segments are lower order perturbations so that the impedance is almost entirely determined by the transmission line "lrdg" which is designed to match that of the coaxial input cable. Tuning of the antenna at these frequencies is, therefore, mainly controlled by the shape and size of the radiating structure "$Z_{ant}$," particularly near the aperture. As the frequency increases, radiation occurs closer to the cavity since the traveling waves on the exponential TEM transmission line convert to radiating spherical modes sooner. At the higher end of the frequency band, the details of the ridged waveguide cavity become almost completely dominant and therefore control the impedance behavior of the antenna. These considerations lead the designer into an iterative design procedure wherein the low and high ends of the frequency band are matched by alternately modifying the radiating structure and the waveguide cavity.

The ridged waveguide transmission line "lrdg" is designed in accordance with the principles of the following references: "Equivalent Circuits for Discontinuities in Transmission Lines," by J. R. Winnery and H. W. Jamieson, *Proceedings of the I.R.E.*, February 1944; "Properties of Ridged Waveguide," by Seymour B . Cohn, *Proceedings of the I.R.E.*, August 1947; and "The Design of Ridged Waveguides," by Samuel Hopfer, *I.R.E. Transactions on Microwave Theory and Techniques*, October 1955. A double ridged waveguide is utilized in the interest of elevation plane symmetry and to minimize the $TE_{10}$ cut-off frequency which broadens the bandwidth by separating the cut-off frequencies for the $TE_{10}$ and $TE_{30}$ modes. Care is taken to limit the distance between the two ridge surfaces and to round off sharp edges, thus avoiding possible voltage breakdown problems. A capacitive coaxial base is attached to the coaxial probe entering the cavity in order to compensate for the inductive reactance of the resulting center post. At the higher frequencies, the reactance at the input of the shorted waveguide cavity behind the probe is of opposite sign to that of transmission lines "lrdgc" and "lrdg" so that the net impedance presented to "$l_{co}$" is relatively constant with frequency, thus providing a mechanism for broadband operation.

For the embodiment illustrated in FIGS. 9–13, the E-plane (y) exponential curve and the H-plane (x) exponential curve follow the equations:

$$y=(+/-)0.15.EXP[Z/18.Ln\ (40)]$$

$$x=(+/-)\ 1.2.EXP[Z/19.731.Ln\ (5)]$$

The gap height = 0.300 inches
The plate width at the feed = 2.40 inches.
The horn aperture = 20 inches.
The horn width = 17 inches.
The horn length = 21 inches.

While several embodiments and variations of the present invention for an ultra-broadband TEM horn antenna are described in detail herein, it should be apparent that the disclosure and teachings of the present invention will suggest many alternative designs to those skilled in the art.

What is claimed is:

1. An ultra-broadband, transverse electromagnetic, exponential horn antenna consisting of:

first and second elongated conductors having a feed end at which the first and second conductors comprise first and second narrow conductive strips, and a radiating or receiving end, with the widths of the first and second elongated conductors expanding exponentially in he H-plane from the feed end to the radiating or receiving end, and also the spacing between said first and second elongated conductors expanding exponentially in the E-plane from the feed end to the radiating or receiving end, thereby providing a double flared, exponentially tapered, transverse electromagnetic horn antenna, and further including a frequency independent tapered balun for converting an input unbalanced transverse electromagnetic wave to a balanced transverse electromagnetic wave, said tapered balum comprising a first narrow microstrip conductor and a second narrow microstrip ground plane conductor parallel to said first narrow microstrip conductor which are connected respectively to the first and second narrow conductive strips at the feed end of the antenna, wherein said first and second microstrip conductors are separated by a thin dielectric having a dielectric constant substantially the same as the dielectric constant of air, and further including a coaxial connector which introduces an unbalanced transverse electromagnetic signal into the antenna, said coaxial connector comprising a central conductor and a concentric outer conductor which are connected respectively to the first and second narrow microstrip conductors of said tapered balun.

2. An ultra-broadband, transverse electromagnetic, exponential horn antenna as claimed in claim 1, further including a parabolic reflector having a focal point, and wherein the antenna is positioned substantially at the parabolic reflector focal point.

3. An ultra-broadband, transverse electromagnetic, exponential horn antenna as claimed in claim 2, wherein the antenna comprises a transmitting antenna and is coupled to an input electromagnetic signal.

4. An ultra-broadband, transverse electromagnetic, exponential horn antenna as claimed in claim 2, wherein the antenna comprises a receiving antenna and produces an output electromagnetic signal.

5. An ultra-broadband, transverse electromagnetic, exponential horn antenna as claimed in claim 1, wherein the antenna comprises a transmitting antenna and is coupled to an input electromagnetic signal.

6. An ultra-broadband, transverse electromagnetic, exponential horn antenna as claimed in claim 1, wherein the antenna comprises a receiving antenna and produces and output electromagnetic signal.

* * * * *

UNITED STATES PATENT AND TRADEMARK OFFICE

CERTIFICATE OF CORRECTION

PATENT NO. : 5,325,105

DATED : June 28, 1994

INVENTOR(S) : Justine D. Cermignani, et al.

It is certified that error appears in the above-indentified patent and that said Letters Patent is hereby corrected as shown below:

Column 7, line 39, Claim 1: "he" should read --the--

Column 8, line 6, Claim 1: "balum" should read --balun--

Signed and Sealed this

Eighteenth Day of October, 1994

Bruce Lehman

*Attest:*

BRUCE LEHMAN

*Attesting Officer*

*Commissioner of Patents and Trademarks*